United States Patent [19]

Peter, III

[11] 4,300,758

[45] Nov. 17, 1981

[54] REVERSER MECHANISM FOR DUPLEX PRINTING/PAPER HANDLING APPARATUS FOR CUT SHEET PRINTING

[75] Inventor: Emmett B. Peter, III, Leesburg, Fla.

[73] Assignee: Burroughs Corporation, Hollywood, Fla.

[21] Appl. No.: 163,395

[22] Filed: Jun. 26, 1980

[51] Int. Cl.[3] ..... B65H 5/00
[52] U.S. Cl. ..... 271/225; 271/184
[58] Field of Search ..... 271/225, 184, 3.1

[56] References Cited

U.S. PATENT DOCUMENTS 4,136,862 1/1979 Kunz ..... 271/225 X
4,145,606 3/1979 Auchinleck ..... 271/184 X

FOREIGN PATENT DOCUMENTS 1169768 11/1969 United Kingdom ..... 271/225

OTHER PUBLICATIONS

IBM Technical Disclosure Bulletin vol. 18, No. 1, p. 40, Jun. 1975, "Sheet Turnover Device", S. R. Harding.

*Primary Examiner*—Richard A. Schacher
*Attorney, Agent, or Firm*—Carl Fissell, Jr.; Kevin R. Peterson

[57] ABSTRACT

A reversing mechanism for use with a cut sheet item feeder in a printer/copier wherein a pair of contrarotating roller members each of which is angularly oriented relative to the horizontal rotative axes thereof operate in conjunction with individual spring biased pressure rollers solenoid actuated so as to cause sheet items disposed therebetween to move selectively in either one of two opposite directions and wherein a one-way movable member disposed in the path of the items prevents the items from returning back into the input pathway. Photo optical control means actuated by passage of each item time the reversal mode of the apparatus by applying a reversal signal to the solenoid actuating device controlling the contrarotating rollers.

10 Claims, 8 Drawing Figures

REVERSER MECHANISM FOR DUPLEX PRINTING/PAPER HANDLING APPARATUS FOR CUT SHEET PRINTING

BACKGROUND OF THE INVENTION

1. Field of the Invention

The invention relates to paper handling apparatus and more particularly to apparatus for automatically reversing the movement of paper/items from an input to an output direction for obverse-reverse printing.

2. Description of the Prior Art

Paper/item handling as employed in printer/copier type apparatus tends to be more or less complicated as the user requirements increase or decrease in complexity. In printer/copier apparatus of the type wherein multiple stacking hoppers, receiving bins, or receptacles are employed, it is usually necessary to provide multiple separate selectable pathways for the items simply as a matter of preventing misdirection of the items into the wrong receptacle.

Prior art apparatus for reversing relatively stiff, fairly rigid items, such for example as card stock or credit card type items, are often employed in magnetic card readers or 24-hour bank teller apparatus. They generally utilize counter-rotating roller sets wherein the item is switched from one set of rollers to another set in order to reverse direction of movement of the item.

Still another type of item reversing mechanism is one wherein the item is shifted back and forth by means of separate solenoids and associated linkage for each set of reversing rolls. Still other reversing techniques employ individual and separate refeeders which feed the items first in one and then in another direction reverse to the first. Another type of reversing mechanism utilizes sets of rollers wherein the paper passes on top of a set of rollers, hits an end stop, and exits underneath.

Each of the foregoing reversing mechanisms has its own assortment of problems. These include high cost, expensive repair, complicated item drive and pathway configuration, as well as relatively poor general efficiency during or under prolonged operation.

BRIEF SUMMARY OF THE INVENTION

The reversing mechanism incorporating the present invention comprises a demountable frame structure to which is mounted a pair of reverse canted drive rollers adapted to be continuously rotated in opposite directions by means of associated drive wheels and pulleys or belts. A solenoid actuated linkage operably associated with the drive rollers is provided for alternatively engaging and disengaging first one and then the other of two spring biased pressure rollers which are adapted to ride against a perimeter of its associated drive roller effective when in the engaged position to move a sheet item in a desired direction against the edge guide of the frame structure past a phototransistor sensing device into engagement with an end stop. Thereafter, the sheet is moved in a reverse direction out of the reversing mechanism so as to be presented to the operably associated photo-receptor drum for printing on the opposite side of the sheet.

With this arrangement a versatile, efficient, relatively inexpensive and easily serviceable modular sheet item reverser assembly is available for use in a wide variety of paper handling applications, certain ones of which will be described as this description proceeds.

It is an important object therefore of the present invention to provide inexpensive, easily repairable, replaceable item/document paper handling reversing apparatus for incorporation into a printer/copier device.

Another important object of the present invention is to provide an item reverser assembly wherein the actuating mechanism is a simple solenoid and associated linkage.

Still a further object of the present invention is a paper item reverser assembly wherein the reversing mechanism is operable in various modes without damage to the items being handled thereby.

It is also an object of the present invention to employ a single actuating member (solenoid) for multiple operations of the reversing apparatus.

DESCRIPTION OF THE PREFERRED EMBODIMENT

Figure 1:
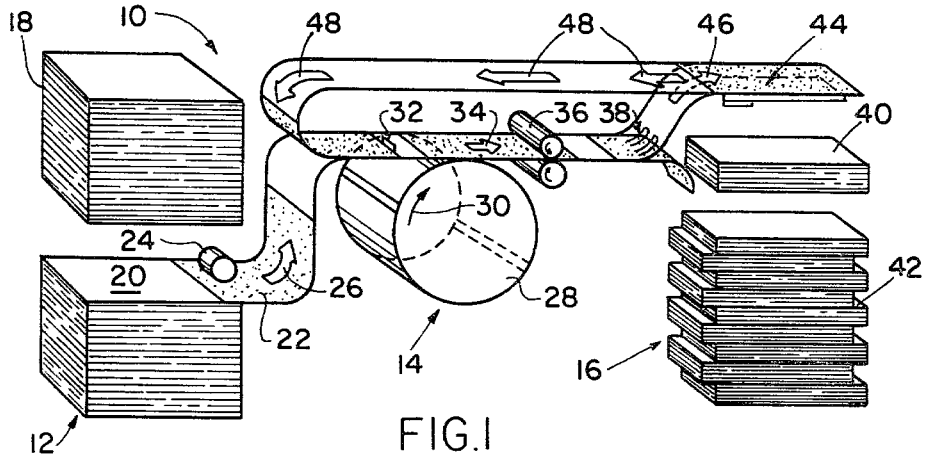
FIG. 1 is a highly schematic illustration of printing apparatus embodying the present invention.

FIG. 1 is a highly idealized illustration of printer/copier apparatus 10 embodying the present invention. As seen therein, the apparatus may include a feeder module 12, a printer module 14 and a stacker module 16. Feeder module 12 comprises a top reloader 18 and a bottom feed stack 20. Cut sheets of paper 22 are fed from bottom feed stack 20 by means of a feeder mechanism 24 in the direction of arrow 26 to printer module 14 and onto a rotatable photoconductive drum member 28.

Drum member 28 rotatable in the direction of arrow 30 and moved by means not shown carries the paper 22 across its external surface portion having been previously aligned along the surface of the drum by means of an interposer mechanism 32 which is the subject of a copending application Ser. No. 138,704, filed Apr. 9, 1980, entitled Four bar interposer mechanism for offset printing, in the names of Emmett B. Peter III and Wilson P. Rayfield and assigned to the same assignee as the present invention.

From the surface of the rotating drum 28, the paper 22 is provided with a reproduction of the data or information carried by drum 28 in a known manner and thence passed in the direction of arrow 34 to a fusing mechanism 36.

Adjacent to but above and slightly rightwardly of the fusing mechanism 36 in the area entering the stacker module 16 is located the diverter gate assembly 38 shown, described and claimed in copending U.S. Patent Application entitled Duplex printing paper handling mechanism for cut sheet printing filed June 26, 1980, Ser. No. 163,394, in the name of Emmett B. Peter III. At the position/location of the diverter assembly 38 a decision is made either to advance the sheet 22 to the sample stacker 40 or to the main stacker 42, or, assuming that both sides of this specific sheet 22 are to be photocopied, the individual sheet is passed to a duplexer-reverser mechanism 44 of the present invention in the direction of arrow 46. At the reverser 44, the sheet of paper is fed in reverse direction as seen by arrows 48 leftwardly back around and into the area adjacent the interposer 32. At this point in time, the electronics (not shown) incorporated in the printer/copier alters the arrrangement of the printing on the surface of the drum 28 to the extent that printing may now be accomplished on the reverse side of this same sheet of paper 22 after which the paper is once again passed to the fuser 36 and then into either the sample stacker 40 or the main stacker 42.

Figure 2:
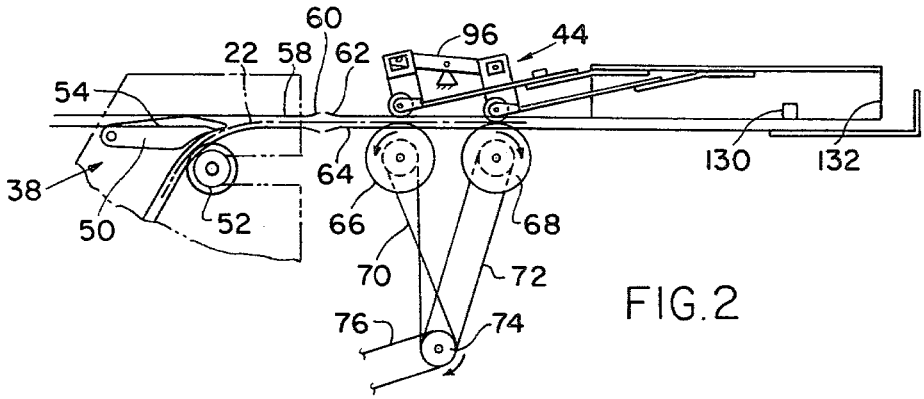
FIGS. 2 and 3 are diagramatic illustrations of the present invention as embodied in the printing apparatus of FIG. 1 illustrating the apparatus during an input phase and a reversing output phase respectively.
Figure 3:
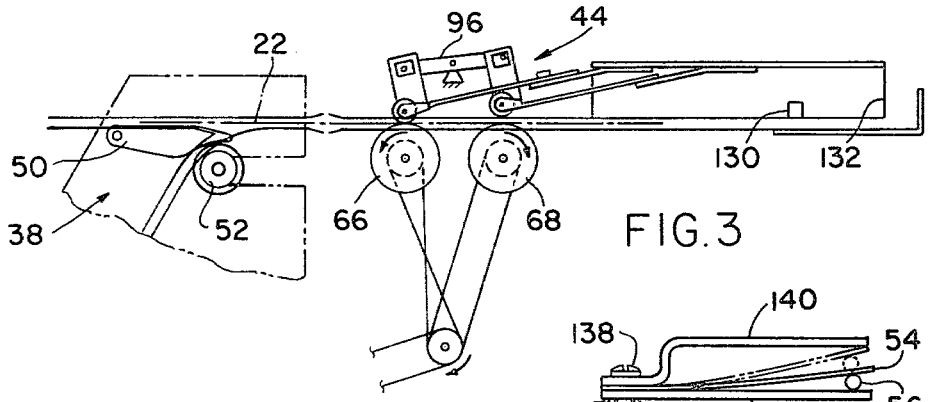

FIGS. 2 and 3 of the drawings illustrate, albeit schematically, the conjoint operation of the reverser mechanism 44 together with the diverter module 38 which was earlier referred to herein.

As seen in FIG. 2, the decision has been made to print the sheet 22 on both sides, i.e. obverse and reverse. As sheet 22 passes between the pairs of one-way gate members 50 (there being a pair of low friction material gate members 50 for each of three high friction material drive rollers 52, the gates 50 straddling the associated drive roller 52) and its confronting drive wheel 52, gate 50, which is very lightly downwardly loaded or biased by means of spring flexure 54 (FIG. 5) against flexure engaging member 56, lifts slightly upwardly due to the pressure of the sheet item permitting the item to pass upwardly into the input-output reverser track 58 (illustrated as part of the diverter module 38). The outwardly flared ends 60 of track 58 abut the similarly flared open ends 62 of reverser input or guide track 64 into which the item is now introduced. Guide track 64 is of generally U-shaped cross section and provides a captive edge guide for the entering and leaving items.

The reversing mechanism 44 of the present invention is seen to comprise oppositely disposed contrarotating drive wheels 66 and 68 driven counterclockwise (CCS) and clockwise (CW) respectively, by means of belts 70 and 72 from input drive roller 74 and drive belt 76. Drive wheels 66 and 68 are disposed at the leading end of the reverser module 44 such that the upper perimeter of each drive wheel 66 and 68 extends slightly above the level of the track projecting through an elongated slot 78 as seen most clearly in FIG. 6 of the drawing. For purposes which will become more clear as the description proceeds, the rotative axes of each of the wheels 66 and 68 respectively are canted slightly at a 3° angle to the normal with respect to one another, i.e. contrarotating wheel 66 is canted at the angle depicted by the dotted line 80 while clockwise rotating wheel 68 is canted 3° at the angle indicated by the dotted line 82. All of this will become logically clear as further description is made of the operation of the device.

Figure 5:
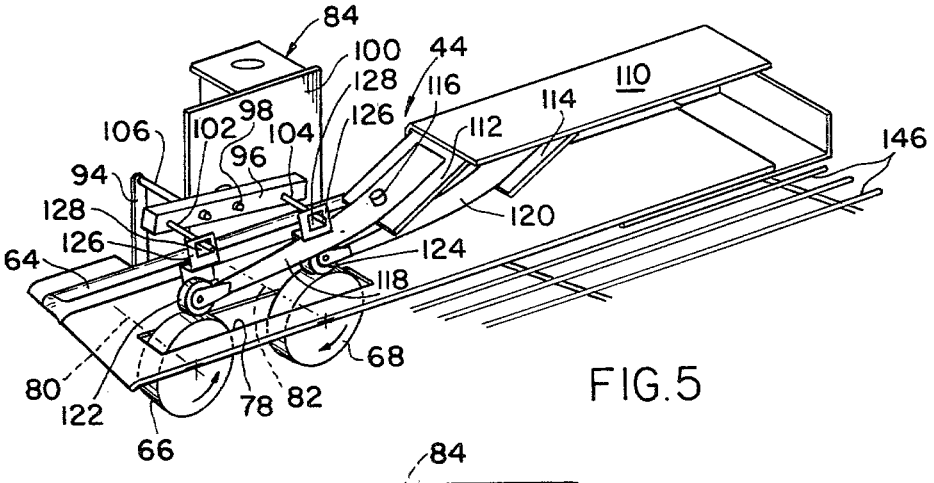
FIG. 5 is an isometric view of the reverser mechanism of the present invention.
Figure 6:
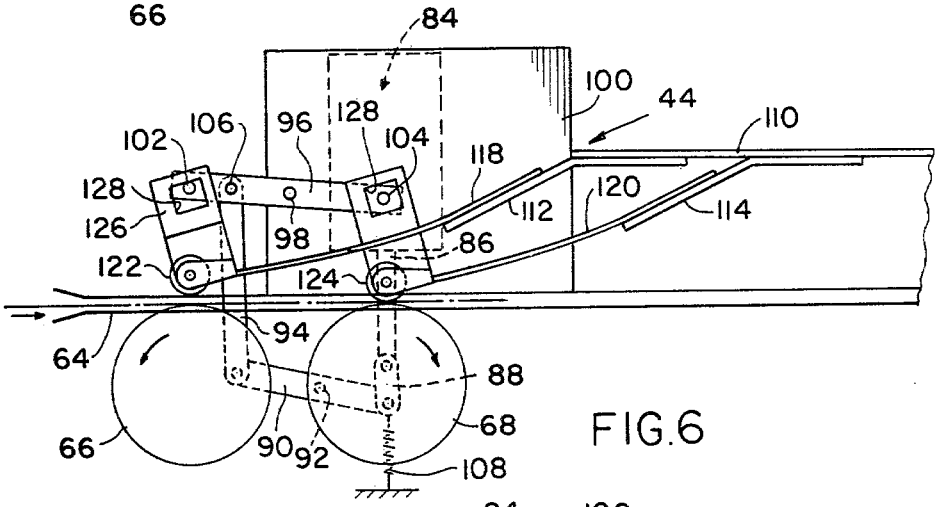
FIG. 6 is a schematic side elevational view of the reverser mechanism incorporating the present invention and operating in the input mode.
Figure 7:
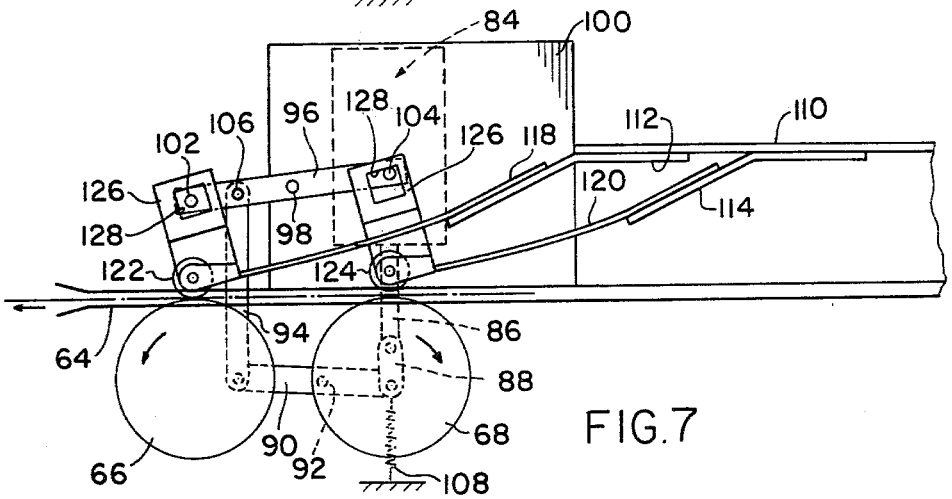
FIG. 7 is a view similar to FIG. 2 but with the mechanism operating in the reverse or output mode.

Referring now to FIGS. 5 through 7 inclusive, the present invention, as illustrated, can be likened to an electromechanical "flip-flop" in which solenoid 84 acting as an input signal driver member has its movable core or plunger 86 (FIGS. 6 and 7) connected to a short stub link 88 for rocking a horizontally movable transfer link 90 about its pivot point 92. Transfer link 90 is connected at its opposite end to a vertical link 94. A horizontally, rockably movable, crossbar member 96 is pivoted at 98 to solenoid support 100 and carries at each opposite end (leftward and rightward) a forwardly extending actuating pin designated 102 and 104, respectively. An elongated rod member 106 connects vertical drive link 94 to crossbar member 96 permitting rocking movement of the crossbar when solenoid 84 is energized as will be described in more detail later on herein. A return spring 108 secured to stub link 88 biases the solenoid plunger outwardly effectively retracting the plunger from the solenoid coil, not shown, when the solenoid is not energized.

Extending angularly, downwardly, leftwardly, in FIGS. 5 through 7 inclusive, from the horizontal overhang 110 are two flat support members 112 and 114. Secured, as by bolts 116, FIG. 5, to each individual flat support 112 and 114 is a leftwardly extending thin, bladelike, flexure member of spring steel, for example, 118 and 120 respectively. A rectangular hook-like transfer link 126, of sheet metal for example, is secured to the end of each flexure member 118 and 120. In a preferred embodiment the transfer link 126 is one piece and contains the support shaft for the respective roller 122–124 and is fastened to the end of the spring flexure. Each transfer link is angled slightly off the perpendicular so as to correspond with the angle of the spring flexure members 112 and 114 as seen most clearly in FIGS. 6 and 7. Horizontally extending pins 102 and 104 are seen to project outwardly away from crossbar member 96 into and through individual rectangular openings 128 in members 126 as shown most clearly in FIGS. 5 through 7 inclusive.

Figure 4A:
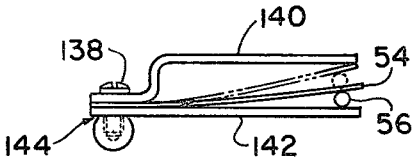
FIG. 4*a* is a greatly enlarged detail view of the biasing means for the device of FIG. 4.
Figure 4:
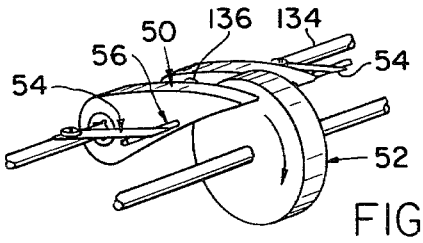
FIG. 4 is a schematic illustration of a one-way gate mechanism for use with the device illustrated in FIGS. 2 and 3.

FIGS. 4 and 4a illustrate in greater detail the structural arrangement of the gate members 50 and the spring biasing flexure members 54 relative to drive rollers 52.

In FIG. 4 members 50 which are seen to straddle each of the three drive roller 52 are pivotally, arcuately, rockably, movably mounted on stationary shaft 134 by means of C-rings 136. Spring biasing flexure members 54 of spring steel for example, are secured as by bolts 138 between "overtravel" and "undertravel" stop members 140 and 142, respectively, on flats 144 on shaft 134. Shaft 134 is made to be angularly adjustable as a means for altering the loading tension of spring flexures 54.

Pin 56 projecting outwardly from the side of each gate member 50 is disposed beneath flexure member 54 as seen most clearly in FIG. 4a and moves the flexure member from the full to the dotted line position shown as the paper sheets pass between the gates 50 and their associated rollers 52. "Overtravel" stop 140 prevents accidental overstressing of flexure member 54, which must be relatively thin and easily flexed for proper operation of the one-way gate 50. The "undertravel" stop 142 is used to hold the gate member 50 in its required position, otherwise gravity would permit it to drop down too far for proper operation.

A plurality of rigid wire form paper supports 146 are arranged in parallel rows adjacent to the reverser mechanism 44 as seen in FIG. 1. These members act to keep the flimsy paper items fairly flat during their inward and outward movement within the reverser 44, and also provide lateral support for the relatively wide sheets. Note that the sheets are edge guided in guide track 64 while being edge driven in respectively "in" and "out" directions by means of rollers 68 and 66 respectively.

OPERATION

When it is desired to print on both sides of a single sheet of cut paper 22 the diverter 38 is energized and actuated such that the selected sheet 22 as seen in FIGS. 2 and 3, is fed into the nip between drive roller 52 and one-way gate 50. Continued forward movement of sheet 22 passes the sheet into the channel guide pathway 64 of the reverser apparatus 44 and into the area of the contrarotating rollers 66 and 68. Rightward roller 68 (FIGS. 2–7) is rotating clockwise as indicated by the arrow while the lefthand roller is rotating counterclockwise as indicated. Both rollers are driven from a single input drive roller 74, through crossed belt 70 and straight line belt 72.

Since it is necessary and desirable for the sheet items 22 to move in orderly fashion into and out of the reverser 44, the sheets are moved against the inboard edge of the pathway guide channel 64 in both input and output directions by canting or angling the axes of the driver wheels 66 and 68 by 3° as seen most clearly in FIG. 5.

In order to move the item 22 into and out of the reverser 44 a normal force is applied to each drive roller 66 and 68 by means of the spring or flexures 118 and 120. FIGS. 2 and 6 illustrate the mechanism 44 with the solenoid 84 deenergized in which case the roller 124 is in light engagement with drive roller 68. FIGS. 3 and 7 illustrate apparatus 44 with solenoid 84 energized. In this case pressure roller 122 is in light engagement with roller 66 (pressure roller 124 is now disengaged.)

As seen in FIGS. 2 and 6, return spring 108 through linkage 88, 90, 94 and pin 106 has rocked crossbar 96 clockwise (right end downwardly; left end upwardly). Flexure 120 which is bowed so as to keep a predetermined light vertical downward pressure on roller 124, with pin 104 now free within opening 128 in rightward transfer link 126, snaps down to engage the roller 124 driving the sheet fully into channel guide 64 of reverser 44. As the sheet 22 passes into the reverser, it blocks photo diode or photo transistor 130 (FIGS. 2 and 3). Sheet 22 continues its onward movement until it abuts stop 132. Photo transistor sends a signal to the main computer controller of the printer apparatus indicating the passage of the sheet item. After a prescribed time delay which is predetermined for proper and accurate registration of the paper relative to the indicia or data on the drum 28 a reverse signal is sent to solenoid 84 pulling in plunger 86 and rocking crossbar 96 counterclockwise (leftward end down; rightward end up). This action frees leftward transfer link 126 from pin 102 permitting flexure 118 to drop its roller 122 into engagement with drive roller 66 while causing pin 104 to pick up rightward link 126 lifting roller 124 and flexure 120 upwardly out of engagement with drive roller 68. Thus the roller 66 now has a normal force applied.

Note that although the sheet item 22 is sandwiched between both rollers and drive rollers during its inward excursion into the reverser the nonengaged roller merely skims the paper since without the normal force applied to it there is no driving engagement.

The item 22 is now reversed and is drawn back out of the reverser 44 and over the top of one-way gates 50 which had snapped down around drive roller 52 but due to the shape of its upper surface prevents the sheet from moving back down the input channel or guide way.

What is claimed is:

1. Apparatus for reversing the direction of movement of cut sheet items continuously moved from an input stack to an output receptacle without interruption or double feed comprising:

oppositely disposed continuously moving contrarotating means arranged in the path of movement of individual cut sheet items, means producing a normal force on one of said contrarotating means for moving an item into said reversing apparatus, means producing a normal force on the other of said contrarotating means for moving said item in reverse direction exiting said item from said reversing means, signal controlled means coupling both said normal force producing means for reversing item direction in response to an applied signal, and one-way means in the entering path of movement of said item effective to prevent backward movement of said item into the entering pathway.

2. The invention in accordance with claim 1 wherein said contrarotating means are individual high friction members.

3. The invention in accordance with claim 1 wherein said normal force producing means is a low friction member.

4. The invention in accordance with claim 1 wherein said contrarotating members are reversely angled relative to each other effectively edge aligning said moving items.

5. The invention in accordance with claim 1 wherein the axes of rotation of said reversely angled members are each arranged at 3° relative to the horizontal rotative axis.

6. The invention in accordance with claim 1 wherein said signal controlled means comprises a plunger solenoid and wherein said coupling means is a four bar linkage permitting a single solenoid to control both contrarotating members.

7. The invention in accordance with claim 1 wherein said reversing apparatus further includes a photo-optical signal producing means disposed in the path of movement of said sheet items effective when interrupted by the item to time the reverse signal applied to the signal controlled solenoid member for reversing the item's movement.

8. The invention in accordance with claim 1 wherein said normal force producing means further includes spring flexure means for biasing said force producing means into contact with the selected contrarotating member.

9. The invention in accordance with claim 1 further comprising a straight line driving means and a cross twisted driving means, both of said means being driven by the same rotative input means with each said driving means being coupled to a separate one of said contrarotating members.

10. The invention in acordance with claim 1 wherein said one-way means comprises an irregularly shaped gate member including means biasing said gate member into a position wherein the forward end of said gate member is slightly below the periphery of an operably associated drive member and wherein said biasing means comprises a relatively light spring flexure member.

* * * * *